US005964421A

United States Patent [19]

Hautala et al.

[11] Patent Number: 5,964,421

[45] Date of Patent: Oct. 12, 1999

[54] METHOD AND ARRANGEMENT FOR TREATMENT OF REJECT MATERIAL

[75] Inventors: Jouko Hautala; Olli Tuovinen, both of Tampere, Finland

[73] Assignee: Valmet Corporation, Helsinki, Finland

[21] Appl. No.: 08/873,623

[22] Filed: Jun. 12, 1997

[30] Foreign Application Priority Data

Jun. 17, 1996 [FI] Finland ..... 962517

[51] Int. Cl.[6] ..... B02C 19/12

[52] U.S. Cl. ..... 241/28

[58] Field of Search ..... 241/80, 28, 97, 241/280, 281, 282

[56] References Cited

U.S. PATENT DOCUMENTS 4,236,959 12/1980 Reinhall .

5,133,507 7/1992 Sepling et al. ..... 241/80

FOREIGN PATENT DOCUMENTS

| | | |
|---|---|---|
| 70936 | 4/1979 | Finland . |
| 803230 | 10/1980 | Finland . |
| 72354 | 9/1984 | Finland . |
| 523560 | 4/1931 | Germany . |
| 118237 | 4/1927 | Switzerland . |

*Primary Examiner*—Mark Rosenbaum
*Attorney, Agent, or Firm*—Ladas & Parry

[57] ABSTRACT

A method and an arrangement for treatment of reject material separated at screening of fibre pulp prepared by grinding wood. In the method reject material is fed against the surface of a grindstone (3) of a pressure grinder immediately before a normal grinding zone (6). The arrangement comprises a reject feeding equipment (12) placed immediately before the normal grinding zone (6) through which the reject material is fed to be ground again.

5 Claims, 1 Drawing Sheet

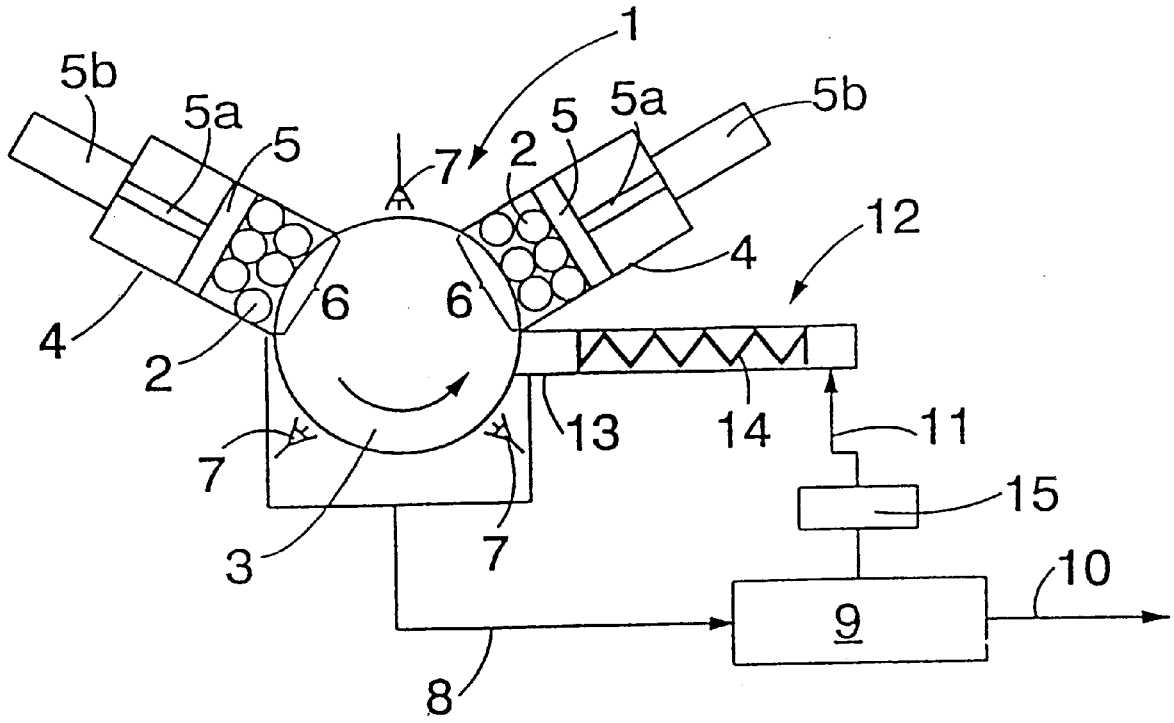
1
5b
5a
5
7
2
5
5a
5b
12
4
6
6
4
2
13
14
11
7
15
3
7
10
9
8

METHOD AND ARRANGEMENT FOR TREATMENT OF REJECT MATERIAL

The invention relates to a method for treatment of reject material separated at screening of fibre pulp prepared by grinding wood, in which method coarser reject material than fibre pulp separated in connection with screening from fibre pulp is conveyed to be defibered again and the fibre material formed after defibering is returned to the process.

The present invention further relates to an arrangement for treatment of reject material separated from fibre pulp at screening of fibre pulp formed in a pulp grinder.

In manufacturing paper and fibre board, the used wood fibre is refined or ground with water so that fibre pulp formed of water and wood fibres is produced. This fibre pulp is screened after that with various screens in order to obtain fibre pulp which is suitable for manufacturing and of a uniform quality. As a consequence of screening, some of the fibre pulp does not pass the screening and this so-called reject is removed from the screen for various further processing in order that as much fibre as possible could be recovered from it and returned to the process. As reject very typically contains various coarser fibres and shive-like parts, it is processed into useable fibre pulp by various reject grinders to which reject is fed separately. In practice it has been found out that the result obtained by present reject refiners is not sufficient but only some of reject can be refined into a suitable form. It can be further stated that refining reject as such is one of the greatest investments in manufacture of ground pulp at present and therefore the result is on the whole rather poor.

U.S. Pat. No. 4,236,959 discloses one known apparatus for grinding reject material to which apparatus reject can be fed at a consistency of 3 to 4% or higher. In this apparatus, mass is fed between grinding discs by a feed screw and it is ground there and it is discharged from the apparatus after having penetrated the interspace between the grinding discs. The problem with this apparatus is also its high price and an unnecessarily poor yield as a result.

Finnish Patent 70936 and Finnish Patent Application 803230 disclose solutions where fibre pulp is ground from wood chips by pressing it against the grinding surface. The fibre pulp produced in this way has also the same reject problems as is intended to be eliminated by means of the apparatus of cited U.S. Pat. No. 4,236,959, for example. Furthermore, it is difficult to realize and control the sealing between the feeding apparatus and the grindstone, in which case a great portion of the material to be fed may pass as such to the screening process.

The object of the present invention is to accomplish such a method and arrangement with which reject can be efficiently and with good quality defibered into a fibre pulp useable in the process. The method of the invention is characterized in that the reject material is fed to a grinder used for grinding wood by means of a separate reject feeding equipment in such a manner that the reject material is pressed against the surface of a grindstone of the grinder for defibering it and that the reject material is fed in the direction of movement of the grindstone essentially immediately before the normal grinding zone of pulp grinder.

The arrangement of the invention is characterized in that the arrangement includes a reject feeding equipment for feeding reject material to the pulp grinder so that the reject is pressed against the surface of the grindstone of the grinder and that the reject feeding equipment for feeding the reject material is placed so that the reject material is fed against the grindstone essentially immediately before the normal grinding zone of the grinder.

The essential idea of the invention is that reject is fed against the grindstone of the pulp grinder with a suitable feeding element, such as a screw, immediately before blocks of wood which are to be ground normally and pressed against the side of the grindstone, in which case the reject is ground as it is pressed and it will be further ground between the grindstone and the blocks of wood in the grinding zone formed by them. In this way the reject will be efficiently defibered by grinding it in the grinder while no separate reject grinders are needed. According to one preferred embodiment of the invention, water is discharged from the reject mass so that a consistency value of 25% or above is attained, whereby it is easier to feed the reject mechanically. At the same time, when desired, chips from a suitable source can be mixed into the reject because chips are ground into fibres in the similar way as reject in such a manner that in the end they will be between the grindstone and other wood material to be ground.

The advantage of the invention is that no separate reject defibering equipment, such as a refiner or a grinder, is needed. A further advantage of the invention is that by returning the reject continuously back to the grinder, it will be essentially defibered completely and utilized in the production of fibre pulp because fibre material need not be removed from the process. A further advantage of the invention is that process control is easier than in prior art.

The invention will be explained in more detail in the appended drawing which shows a schematic view of the equipment of the invention.

The FIGURE shows a schematic view of the equipment suitable for implementing the method of the invention. The FIGURE shows a schematic view of a grinder 1 which can either be a pressureless or a pressure grinder. Blocks of wood 2 are fed thereto in the normal way through feeding chutes 4 on both sides of a grindstone 3 of the grinder and after that blocks of wood are pressed generally by a hydraulically operating piston 5 against the surface of the grindstone when the grindstone rotates. Then the grinding area of the blocks of wood forms a grinding zone where the blocks of wood and the grindstone are in contact with one another and the grindstone defibrates the blocks of wood due to their transverse rotating motion. The structure and operation of the grinder are as such generally known to persons skilled in the art and therefore they are not explained in more detail herein. At the feeding chute 4 a grinding zone 6 is formed at the blocks of wood pressing against the grindstone 3, that is, in the width in the direction of the circumference of the feeding chute. Water is further fed to the grinder 1 in the manner known per se with nozzles 7, the water sprayed with the nozzles forming fibre pulp along with the wood fibre formed during grinding. The fibre pulp is fed via a pipe 8 starting from the lower portion of the grinder 1 to screening 9 where it is screened in various ways with screening devices known per se. More generally used screeners are now various screens where the fibre pulp is fed inside a separate screen cylinder and acceptable fibres and some of the water is discharged through openings in the screen cylinders and it is conveyed to further processing 10, that is, typically to a head box of a paper machine or the like and therefrom to be produced as fibrous web. Reject material 11 is discharged from the screening 9, the reject material comprising shives and such fibre material that is too coarse to pass through screening. At the same time water is naturally also discharged therefrom along with the reject material. The reject material 11 is conveyed forwards to be ground again in the grinder. A separate reject feeding equipment 12 is installed in the grinder for this purpose, which equipment comprises a feeding chute 13 extending to the surface of the grindstone 3 for feeding reject material against the grindstone 3. For feeding the reject material, the equipment comprises separate feeding means 14 which dose and feed the reject material through the feeding chute 13 to the grindstone 3. These feeding means 14 are preferably feed screws or the like to which the reject material can be fed and which move it at the set speed forwards against the grindstone 3. When the feeding chute 13 is in the direction of rotation of the grindstone 3 immediately before the actual grinding zone 6, the reject material will be ground first at the feeding chute 13 and the fibres detached after that will be at the grinding zone 6 between the blocks of wood and the grindstone 3, whereby they will be ground there more and cannot pass freely along with the grindstone 3. In this way the reject material will be ground again and then the fibres contained in the reject material will be returned to the process in a simple and easy way.

In order to feed reject material to the grinder, water has to be discharged therefrom so that its consistency will be suitable for grinding. This can be done by using a separate concentrator 15 indicated with broken lines in the FIGURE through which the reject material is fed with the feeding equipment 12. On the other hand, the concentrator may be included as a part of the feeding equipment, in which case water is discharged from it in the feeding equipment and from the feeding equipment at the feeding chute 13, the reject material has a dry solids content of about 25%. In practice the dry solids content of the reject material when feeding it for grinding can be about 10 to 50%, but preferably about 25 to 35%.

The invention is shown above in the specification and in the drawings only by way of example and it is in no way limited thereto. The feeding of reject material can be done by means of one or more separate reject feed equipments as long as the reject material is fed directly before some normal grinding zone where blocks of wood are pressed against the surface of the grindstone for grinding them. The feeding mechanism of reject material can be of various kinds and it can be made either as a continuous process with e.g. a feed screw or the like or it can be made in sequences by using a separate piston for pressing reject material and by feeding a new reject material in suitable quantities between the piston and the grindstone. Although the specification illustrates a hydraulically operating grinder, the invention is in no way restricted to be used only in connection with it. The feed mechanism or the equipment of normal grinding can be any, such as chain feed or any feeding equipment known per se. It is essential that the reject feeding equipment feeds the reject material in the direction of rotation of the grinder immediately before the normal grinding zone in order that the reject material will be between the blocks of wood to be ground and the grindstone for grinding.

We claim:

1. A method for treatment of reject material separated at screening of fiber pulp prepared by grinding wood, said reject material comprising a fiber-containing material that is coarser than the fiber pulp and water, said method comprising the steps of:

(a) discharging water from the reject material so that the dewatered reject material has a dry solids content of at least 10%; and (b) feeding the dewatered reject material to a grinder, said grinder having a grindstone that moves in a certain direction and that has a grinding zone wherein wood to be ground contacts the grindstone, said dewatered reject material being fed to the grinder in the direction of movement of the grindstone essentially immediately before the grinding zone such that the dewatered reject material is pressed against the grindstone with defibering of the fiber-containing material.

2. A method according to claim 1 comprising separating the reject material from the fiber pulp by screening prior to step (a), and feeding all of the reject material separated by the screening to the grinder in step (b).

3. A method according to claim 1 comprising discharging water from the reject material in step (a) so that the dewatered reject material has a dry solids content of at least 25%.

4. A method according to claim 1 comprising discharging water from the reject material in step (a) so that the dewatered reject material has a dry solids content of between 25–35%.

5. A method as claimed in claim 1 comprising feeding wood into said grinding zone and grinding the wood against said grindstone with application of water to form said fiber pulp, and screening the fiber pulp to form screened fiber pulp and said reject material.

* * * * *